United States Patent [19]

Berchem

[11] Patent Number: 4,711,504

[45] Date of Patent: Dec. 8, 1987

[54] ROTATING CUTTER HEAD

[75] Inventor: Rütger Berchem, Gelsenkirchen, Fed. Rep. of Germany

[73] Assignee: Berchem & Schaberg GmbH, Gelsenkirchen, Fed. Rep. of Germany

[21] Appl. No.: 901,287

[22] Filed: Aug. 27, 1986

[30] Foreign Application Priority Data

Sep. 3, 1985 [DE] Fed. Rep. of Germany ..... 3531384

[51] Int. Cl.[4] ..... E21C 35/18

[52] U.S. Cl. ..... 299/86; 37/142 R; 299/91

[58] Field of Search ..... 299/85, 86, 91–93; 175/292, 354; 37/142 R, 142 A

[56] References Cited

U.S. PATENT DOCUMENTS

| | | | |
|---|---|---|---|
| 1,819,273 | 8/1931 | Weisgerber | 175/292 |
| 3,751,114 | 8/1973 | Davis | 299/85 |
| 3,833,264 | 9/1974 | Elders | 299/86 |
| 4,595,241 | 6/1986 | Gilbert et al. | 299/93 |

FOREIGN PATENT DOCUMENTS

| | | | |
|---|---|---|---|
| 3336154 | 4/1985 | Fed. Rep. of Germany | 299/86 |

*Primary Examiner*—Stephen J. Novosad
*Assistant Examiner*—David J. Bagnell
*Attorney, Agent, or Firm*—Karl F. Ross; Herbert Dubno

[57] ABSTRACT

The tool unit is for a rotating cutter head which is operating along the face to be worked on by an excavator or similar machine, with the unit being comprised of a mounting base and an upper tool member. The unit can be secured by welding at the cutter head, and the upper tool member is of knife-like cross section. The cutting edge can be brought into a predetermined operating position. The upper tool member is mounted for rotation in the mounting base of the unit. The mounting of the upper tool member is such that it can rotate or turn about an axis which is inclined or orthogonally disposed at the cutter head with respect to the direction of rotation of the unit. The tool unit is also characterized thereby that the cutting edge of the upper tool can be aligned for operation by way of the attendant cutting forces or forces of reaction.

5 Claims, 3 Drawing Figures

ROTATING CUTTER HEAD

FIELD OF THE INVENTION

My present invention relates to a tool holder and its associated tool, for cutter heads used in mining, dredging or similar excavating operations.

BACKGROUND OF THE INVENTION

Mining machines, dredges and other excavators have cutter heads mounted at the machine so as to be capable of performing rotating and linear motions along the wall or a face of the particular material that is being worked on, e.g. coal, minerals and so forth.

The head is usually provided with a support carrying a multiplicity of tool units each of which is comprised of a lower mounting base and the upper tool member which ultimately carries out the cutting action of the machine. The mounting base or holder can be secured to the support at the cutter head by welding. The upper tool member is formed with a knife or like edge which can assume a predetermined operative or cutting position.

The reference to mining, dredging or excavating machines herein is to include those which are used for the mining or excavating of minerals, coal, rock, and the like substances or for removal or displacement of mineral matter. The term is also intended to include suction dredges and like equipment.

In a known tool unit, the lower mounting base and the upper tool are combined in a fixed integral unit which is substantially rigidly secured at the cutter head. The cutting position or attitude of the prior art tool unit is set when it is secured at the respective location on the cutter head which, in turn, confronts the wall or surface to be worked on in a substantially predetermined manner. Thus, the prior art tool can be positioned in a relatively optimal and constructive way.

However, during the operation when the cutter head is repositioned, for example by being swung in an arcuate path, changes in the position of each tool unit from its initial attitude or position occur, and the initially optimal position of the tool unit with respect to the face that is being worked on can be lost. The resulting loss of efficiency has not been addressed in the past, but has been taken as being inherent in the nature of such cutters.

Partial cutter machines are known for other purposes, such as tunneling and underground excavating. These machines have cutting heads which are equipped with tool holders and cutting bits or chisels which are formed as so-called pickbits. These comprise a cylindrical shaft, a more or less conical head, and a carbide or hardmetal tip secured in the head and having a corresponding conical configuration. The cylindrical shaft is mounted in a corresponding bore of the associated toolholder and is retained so as to be able to rotate.

When the cutting head rotates, the chisels also turn or rotate with respect to the central longitudinal axis of the cylindrical shaft, due to the attendant cutting forces and the respective forces of reaction. The central longitudinal axis of the cylindrical shaft is positioned in the plane of rotation of the chisels when the cutting head rotates.

The known designs, however, have not provided the improvements and advantages of the type of tool unit as is envisaged by the invention.

OBJECTS OF THE INVENTION

It is the principal object of my invention to provide a tool unit which avoids the prior art drawbacks and wherein the cutting edges align themselves for effective operation with respect to the surface to be worked on by the associated cutter head.

It is also an object of the invention to provide a tool unit wherein the cutting edges align themselves for effective operation irrespective of swinging movements or the like repositioning of the cutter head.

In accordance with another object of the invention, the cutting edge of each tool unit is effectively positioned for operation in accordance with its predetermined or design-specific attitude.

SUMMARY OF THE INVENTION

These and other objects and advantages of my invention are attained by mounting the upper tool member in the mounting base of the unit so as to be able to carry out rotating or turning movements relative to this base or holder. With respect to the direction of rotation of the entire unit, the respective axis of rotation is inclined or orthogonally disposed at or with respect to the axis of rotation at the cutter head, i.e. generally transversely to the latter axis. Furthermore means are provided so that the cutting edge of each upper tool member is aligned by way of the attendant cutting forces or forces of reaction for its cutting or working operation.

The means or elements which are particularly reliable and serve to align or control the adjustment of the cutting edge can include a wedge-like cross section of the upper tool member having a forwardly directed cutting edge. The surfaces or flanks of the cutting edge which lead from the apex or cutting edge are curved in concave manner.

It is further preferred that the surface which forms the base of the wedge-like or triangular shape is also curved in concave manner. When the tool unit is rotated at the cutter head, as it were, behind the upper tool portion a free space is created, and this can contribute to stabilization of the unit.

As well, the rotary mounting or retention of the upper tool member which allows turning motions thereof at the mounting base can be done in various ways. More particularly, it is preferred that the upper tool member is mounted with a pivot portion or shank in the mounting base so as to be able to carry out the turning or rotating motions. The shank can be retained at its free end by means of a snap ring.

The mounting base can be secured by welding techniques to the cutter head or cutter head formations. As well, the mounting base can be attached by way of separate fasteners to the cutter head.

It is within the scope of the invention that the tool unit can be combined with other tools and units, as required.

BRIEF DESCRIPTION OF THE DRAWING

The above and other objects, features and advantages will become more readily apparent from the following description, reference being made to the accompanying highly diagrammatic drawing in which.

SPECIFIC DESCRIPTION

Figure 1:
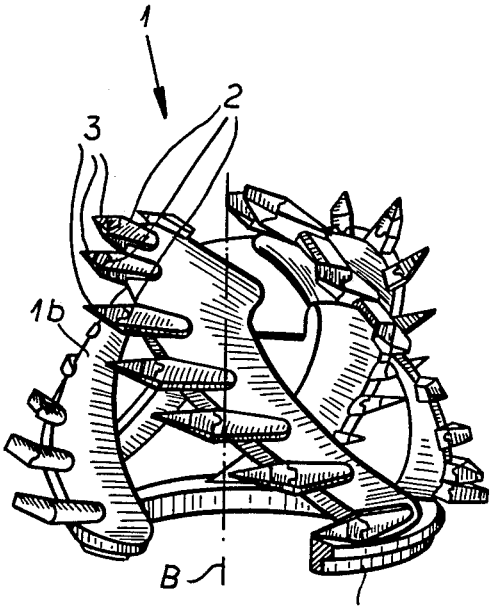
FIG. 1 is a perspective view of a cutter head on which are provided tool units according to the invention.

The tool unit T shown in greater detail in FIG. 1 of the drawing, can be used with a cutter head 1 comprised of a base ring 1*a* and helically disposed arms 1*b* which serve to provide the base for the tool units T. The cutter head 1, rotatable about an axis B, can be that of a suction dredge or the like machine.

Each tool unit T is comprised of a lower mounting base 2 and an upper tool member or cutter 3. The tool units T can be secured at the cutter head 1 to a support by way of welding techniques, or by way of other fastening means, not shown in detail.

The upper tool member 3 has a knife-like edge 4 adapted to be disposed in a predetermined cutting position, or allowing a predetermined cutting position. For the most efficient operation this position must be maintained.

Figure 2:
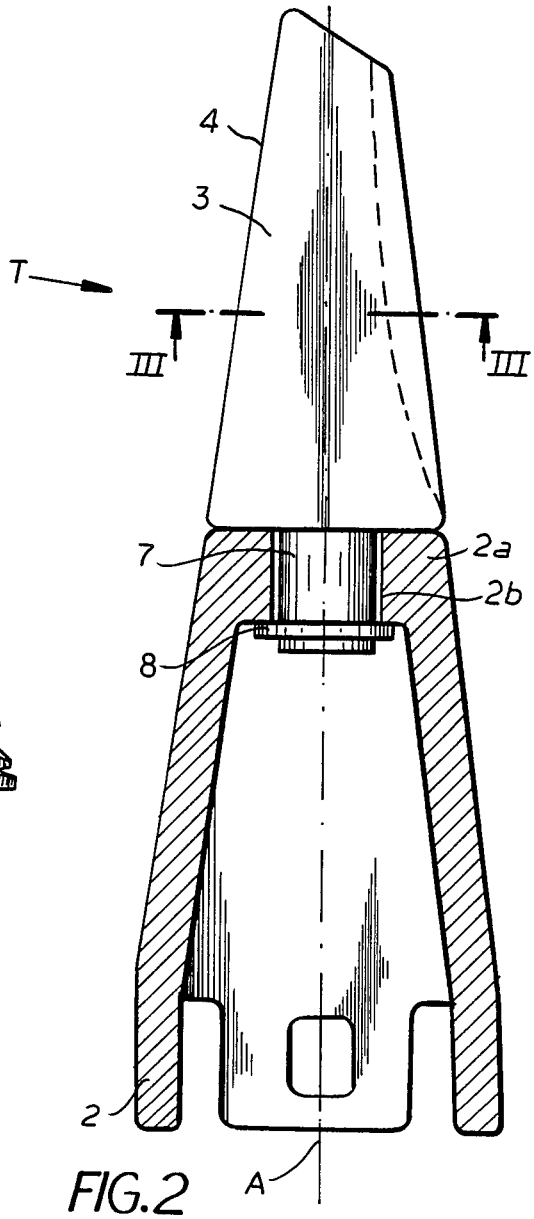
FIG. 2 is an enlarged view partially in cross section of a tool unit of the invention.
Figure 3:
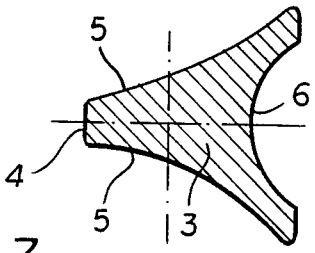
FIG. 3 is a cross section along line III—III of FIG. 2.

As can best be seen with reference to FIGS. 2 and 3, it is clear that the upper tool member 3 is mounted so as to be able to rotate or turn in the mounting base 2. With respect to the direction or plane of rotation of the unit T, the axis of rotation A extends inclined to or orthogonal with respect to the cutter head and axis B.

Furthermore, the arrangement is such that the cutting edge 4 can be aligned or directly positioned at the surface to be worked on by way of the cutting forces and/or forces of reaction acting on the upper tool portion 3.

The alignment is achieved, in accordance with the shown embodiment, thereby that the upper tool member 3 is configured to present a wedge-like or triangular cross section. The cutting edge 4 is then provided at the apex and along the length of the tool member 3. The respective flanks or sides 5 (FIG. 3) leading from the apex are curved in concave manner to effect the alignment action, or to be conducive to the alignment/positioning of the cutting edge 4. The base 6 in the triangular cross section is also curved in concave manner.

Securement of the upper tool member 3 at the mounting base 2 is provided by way of an integral shank or pivot pin portion 7 of the upper tool member 3, with rotation being about the center or axis A thereof. The snap ring 8 serves to retain and secure the upper tool member 3 but allows the turning or alignment motions for selfpositioning of the blade 3 to attach the material to be excavated with its edge 4.

The mounting base 2 has a collar section 2*a* with a passage 2*b* for the shank or pivot pin 7 of the upper tool member 3. The mounting base can otherwise be hollow as is generally shown in FIG. 2.

I claim:

1. A rotating cutter head which can be moved against a surface that is to be worked on an excavating machine, said head comprising:

a rotatable support comprising a base ring and a plurality of helically disposed arms mounted on said ring;

a multiplicity of tool units positioned on said helically disposed arms of said support, each of said tool units comprising:

a respective mounting base secured to said arms, a respective tool member having at least one cutting edge for each said base, said tool member having a wedge-shaped cross section defining with flanking surfaces on either side of an apex of said cutting edge, said surfaces being curved in a concave manner, and means for operatively connecting each tool member to the respective mounting base such that the tool member can carry out swiveling movement about a respective axis of rotation, said axis being inclined with respect to an axis of rotation of said support, said swiveling movement being in response to an alignment of the respective edge caused by a cutting force or reaction force in an excavating attack position.

2. The rotating cutter defined in claim 1 wherein said respective axis of rotation of each said tool member is orthogonally disposed with respect to the axis of rotation of the support at least in one position of said support rotation unit.

3. The rotating cutter defined in claim 1 wherein said tool member has means for aligning its cutting edge with respect to the surface to be worked on.

4. The rotating cutter defined in claim 1 wherein a base surface of each member which is positioned opposite with respect to the cutting edge is of concave curvature.

5. In a tool unit for an excavating machine, said tool unit being adapted to be secured to a rotating cutter head of the respective machine for being moved when the cutter head is rotated for excavating materials, said unit comprising a lower mounting base and an upper tool member having a cutting edge, the improvement wherein the upper tool member is mounted for rotation in the mounting base of the unit such that an axis of rotation of said member is maintained in predetermined position in relation to the cutter head wherein the cutting edge can be aligned for cutting operation by way of cutting forces and/or forces of reaction acting on the upper tool member, said tool member having a wedge-shaped cross section defined with flanking surfaces on either side of an apex of said cutting edge, said surfaces being curved in a concave manner, and wherein said axis of rotation is inclined with respect to an axis of rotation of a support onto which said tool unit is attached.

* * * * *